US007152546B2

(12) United States Patent
Bernath

(10) Patent No.: US 7,152,546 B2
(45) Date of Patent: Dec. 26, 2006

(54) BOAT DRAIN PLUG SYSTEM

(75) Inventor: Chris Bernath, East New Market, MD (US)

(73) Assignee: Bernath Engineering Concepts, Inc., Orlando, FL (US)

( * ) Notice: Subject to any disclaimer, the term of this patent is extended or adjusted under 35 U.S.C. 154(b) by 31 days.

(21) Appl. No.: 11/137,310

(22) Filed: May 24, 2005

(65) Prior Publication Data

US 2006/0266272 A1 Nov. 30, 2006

(51) Int. Cl.
*B63B 13/00* (2006.01)

(52) U.S. Cl. ..... 114/197

(58) Field of Classification Search ..... 296/97.22; 248/309.1; 220/86.2; 215/390; 114/197, 114/198

See application file for complete search history.

(56) References Cited

U.S. PATENT DOCUMENTS 1,446,812 A 2/1923 Sager
1,607,774 A 11/1926 Morse
3,430,795 A * 3/1969 Laufer ..... 215/2
4,145,939 A 3/1979 Garrison
4,552,282 A 11/1985 Nishida
4,794,827 A 1/1989 Poling
5,096,154 A 3/1992 Ellis
5,580,019 A * 12/1996 Glesser ..... 248/309.1
6,131,755 A 10/2000 Soyka
6,227,132 B1 5/2001 Garcia
6,390,007 B1 5/2002 Walker
6,568,648 B1 * 5/2003 Ray ..... 248/538

OTHER PUBLICATIONS

Page 365, S & J Products, Plug Caddy, West Marine Master Catalog 2005, by West Marine Products, Inc.

* cited by examiner

*Primary Examiner*—Stephen Avila
(74) *Attorney, Agent, or Firm*—Terry M. Sanks, Esquire; Beusse Wolter Sanks Mora & Maire, P.A.

(57) ABSTRACT

A boat drain plug system for attachment to a drain hole within a boat hull, the system including a flange including a threaded sleeve that fits within the drain hole and a threaded opening, a cylindrical drain plug adapted for individually coupling with the threaded sleeve and the second threaded opening wherein the drain plug may be fitted into the threaded opening to secure the drain plug when the sleeve needs to be completely open to allow water to exit a boat.

18 Claims, 3 Drawing Sheets

BOAT DRAIN PLUG SYSTEM

BACKGROUND OF THE INVENTION

The present invention relates to a drain plug system, and more particularly to a drain plug system for a boat wherein the drain plug may still be held attached to the drain plug system while a drain hole is open.

Drain plugs are typically used in various types and styles of boat holes. Usually a sleeve fits within a drain opening, or hole, and a plug fits within the sleeve. The purpose of the plug and drain hole is to allow water that may have gotten into the boat to be released, through the drain hole when the plug is removed, while the drain hole is no longer beneath a body of water.

In the prior art, once removed from the drain hole, some drain plugs have no further connection to the drain hole or boat. In such situations the drain plugs may become lost. In other prior art the drain plug is attached to either the drain hole or boat by a chain or some other connection device. In these situations the plugs are always attached to the drain hole or boat. Depending on how the plug is attached, the plug may be in a position that if debris is in the water in the boat, the plug could block the debris from flowing out of the drain hole, which depending on the type and amount of debris may block the flow of water out of the boat. In addition, drain plugs which are attached via a chain or other mechanism can cause damage to the exterior of the boat while trailering, if left secured to the boat with only the chain.

BRIEF DESCRIPTION OF THE INVENTION

Towards this end, a system, improvement, and apparatus for a boat drain plug apparatus is provided. The system comprises a flange including a threaded sleeve that fits within the drain hole and a threaded opening. A cylindrical drain plug adapted for individually coupling with the threaded sleeve and the second threaded opening is also included. Wherein the drain plug may be fitted into the threaded opening to secure the drain plug when the sleeve needs to be completely open to allow water to exit a boat.

The improvement comprises a threaded plug holder opening attached to the boat hull operable to receive the drain plug when the drain plug is removed from the sleeve in a drain plug apparatus wherein a boat drain opening is formed in a boat hull through which a threaded sleeve fits and a drain plug that is threaded and fits within the sleeve.

The apparatus comprises a threaded sleeve that fits within a drain opening. A cylindrical drain plug adapted for coupling with the threaded sleeve, and a threaded plug holder opening attached to the boat hull operable to receive the drain plug when the drain plug is removed from the sleeve are also disclosed.

BRIEF DESCRIPTION OF THE DRAWINGS

The figures shown depict only exemplary configurations that may be employed for the present invention. Those skilled in the art will recognize variations to the figures presented herein. The features and advantages of the present invention will become apparent from the following detailed description of the invention when read with the accompanying drawings in which.

DETAILED DESCRIPTION OF THE INVENTION

With reference to the figures, exemplary embodiments of the invention will now be described. Before proceeding to a detailed description of the preferred embodiments of the present invention and alternate embodiments, several general comments should be made about the applicability and the scope of the present invention. The scope of the invention disclosed is applicable to a plurality of uses, such as but not limited to other devices where a plug is used where it must be removed temporarily and then returned to a primary location. Thus, even though embodiments are described specifically to boat hulls, the present invention is applicable to other uses or applications.

Figure 1:
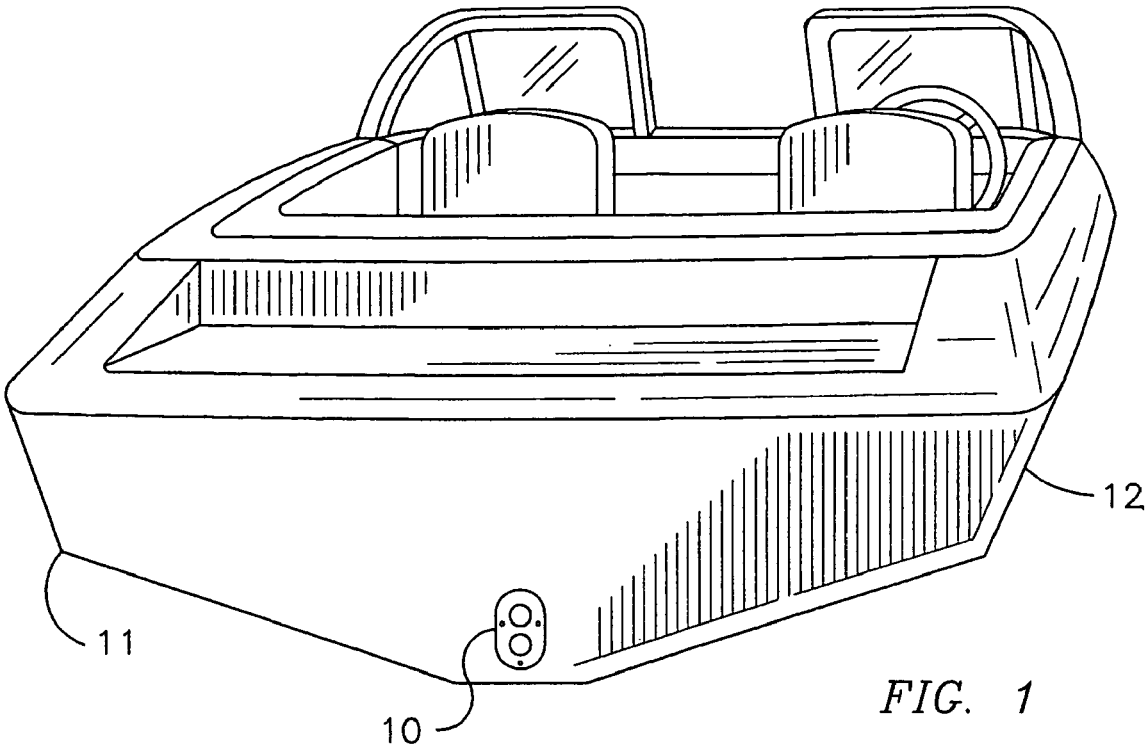
FIG. 1 is an exemplary embodiment of a boat hull with the present invention attached.
Figure 2:
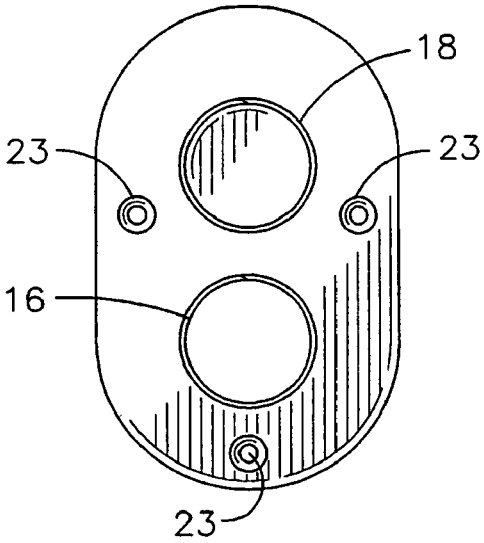
FIG. 2 is a front view of the present invention.

As illustrated in FIG. 1, the present invention 10 is usually installed in the transom of a hull 11 of a boat 12 where there is usually a drain opening 14, as illustrated in FIG. 2. As further illustrated in FIGS. 2 and 3, a sleeve 16 having a flange 17 is disposed in the drain opening 14. The interior of the sleeve 16 is threaded. A plug 20 fits within the sleeve 16 and is also threaded so that it can engage the threads within the sleeve 16. The flange 17 is located on the exterior of the hull 11 wherein a second opening 18 is provided. In one preferred embodiment, the second opening 18 has a closed end, or in other words does not traverse therethrough the flange 17. In another preferred embodiment, the second opening is not closed wherein the hull is visible through the second opening. The second opening 18 is also threaded to receive the plug 20. When the plug 20 is removed from the sleeve 16, a user can then connect the plug 20 to the second opening 18 to insure the plug 20 is secured to the boat 12 while water is being drained from the boat 12. As further illustrated in FIG. 2, the flange 17 may have additional holes 23 or openings through which fasteners such as screws may be inserted and secured to the hull 11 which in turn secures the flange 17 to the boat 12. In another embodiment, the flange 17 may be adhesively attached to the boat 12.

Figure 3:
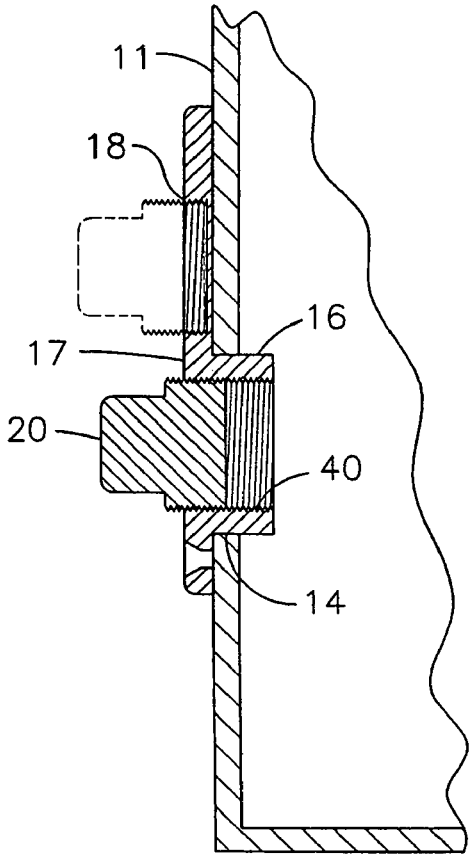
FIG. 3 is an exemplary illustration of a cross-sectional side view of the present invention.

As further illustrated in FIG. 3, the drain plug 20 has a radially cylindrical body with threads displaced around the outer circumference of the body to engage the sleeve 16 as well as the second opening 18. In a preferred embodiment both the drain plug 20, flange 17 and sleeve 16 are made of any suitable marine material, such as but not limited to brass and/or plastic.

In operation, when the drain plug 20 is removed from the sleeve 16, by twisting the drain plug 20 and allowing the threads to operate to result in removal of the drain plug 20, then the drain plug 20 may then be connected to the second opening 18, thus being out of the way of any debris that may flow from the sleeve 16. Once removed, the drain plug 20 may then be securely stowed. Though illustrated with the second opening 18 being above the sleeve 16, those skilled in the art will readily recognize that the second opening 18 may be located at any location, such as but not limited to beneath the sleeve 16 and/or in the same horizontal plane as the sleeve 16.

Figure 4:
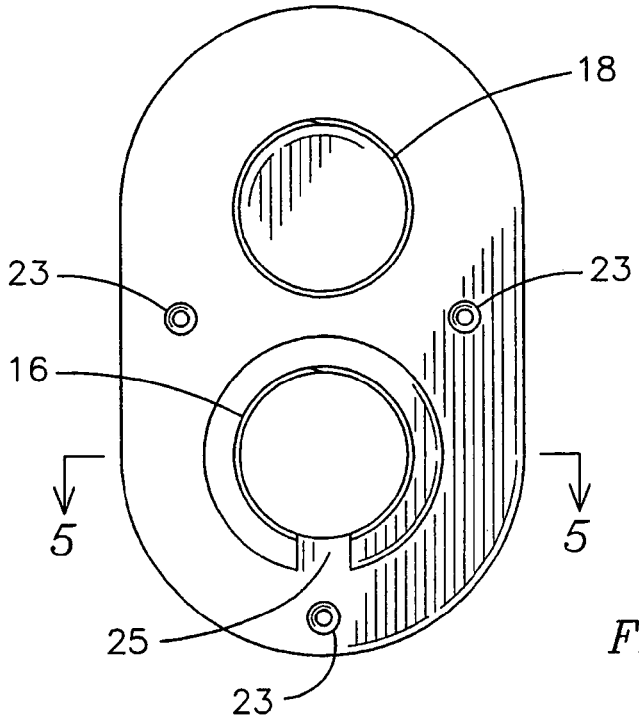
FIG. 4 is an exemplary embodiment of a front view of another preferred embodiment of the present invention.
Figure 5:
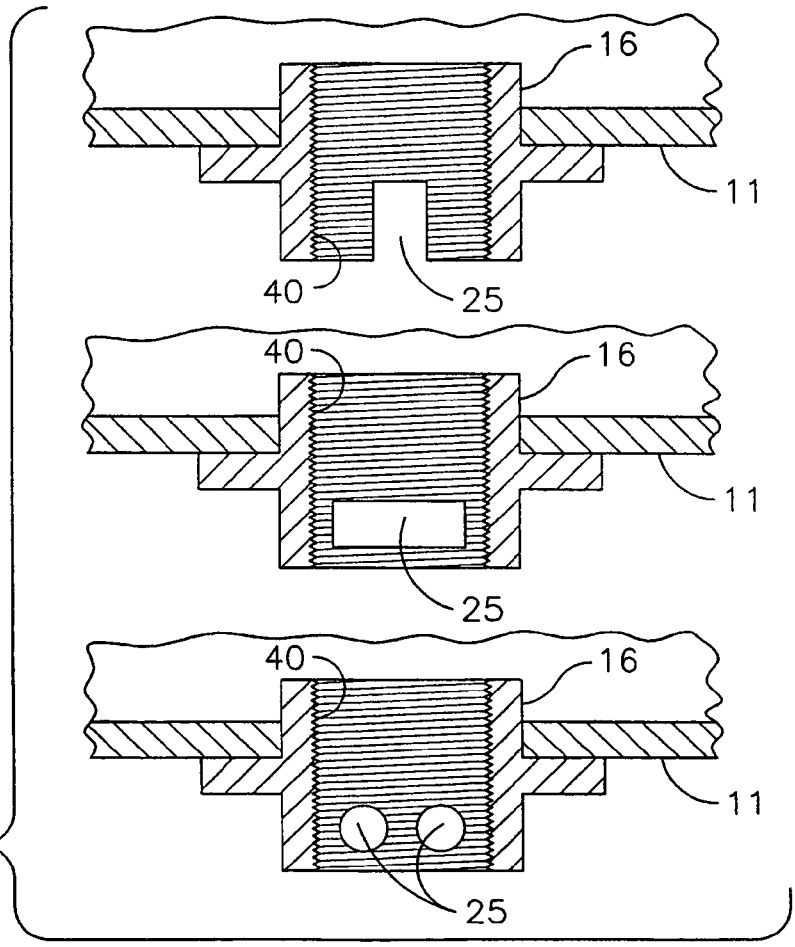
FIG. 5 is a top cross sectional view of various embodiments of a sleeve of a drain hole.

In another exemplary embodiment, as illustrated in FIGS. 4 and 5, instead of requiring the drain plug 20 to be completely removed from the sleeve 16 to allow water to flow from the drain opening 14, the sleeve 16 is configured to allow water to flow from the sleeve 16 when the drain plug 20 is partially removed from the sleeve 16. As illustrated in FIG. 5, the sleeve 16 extends out a given distance from the exterior of the hull. The bottom part of the sleeve 16 has an opening 25, such as a slit which begins at a given distance exterior of the hull 11 and is then displaced through the remaining part of the sleeve 16. In this embodiment, the rest of the interior surface of the sleeve 16 retains threads 40 which guide the plug 20 as it is further removed to insure that the opening 25 is free to allow water to flow out.

In other embodiments, the opening 25 may take on other configurations, such as but not limited to those further illustrated in FIG. 5. The openings 25 provides for a path for water to be displaced from the hull 11. The amount of area accessible by water within the opening 25, will be based on how engaged, or screwed in or out of the sleeve, the drain plug is within the sleeve.

Thus in operation, if no debris is in the water being displaced from the boat 12, the user does not need to completely remove the drain plug 20 from sleeve 16, but instead only remove it far enough to allow water to flow from the opening 25 provided in the sleeve 16. However, if debris is also mixed with the water in the boat 12, then the user can completely remove the plug 20 and attach it to the second opening 18.

Figure 6:
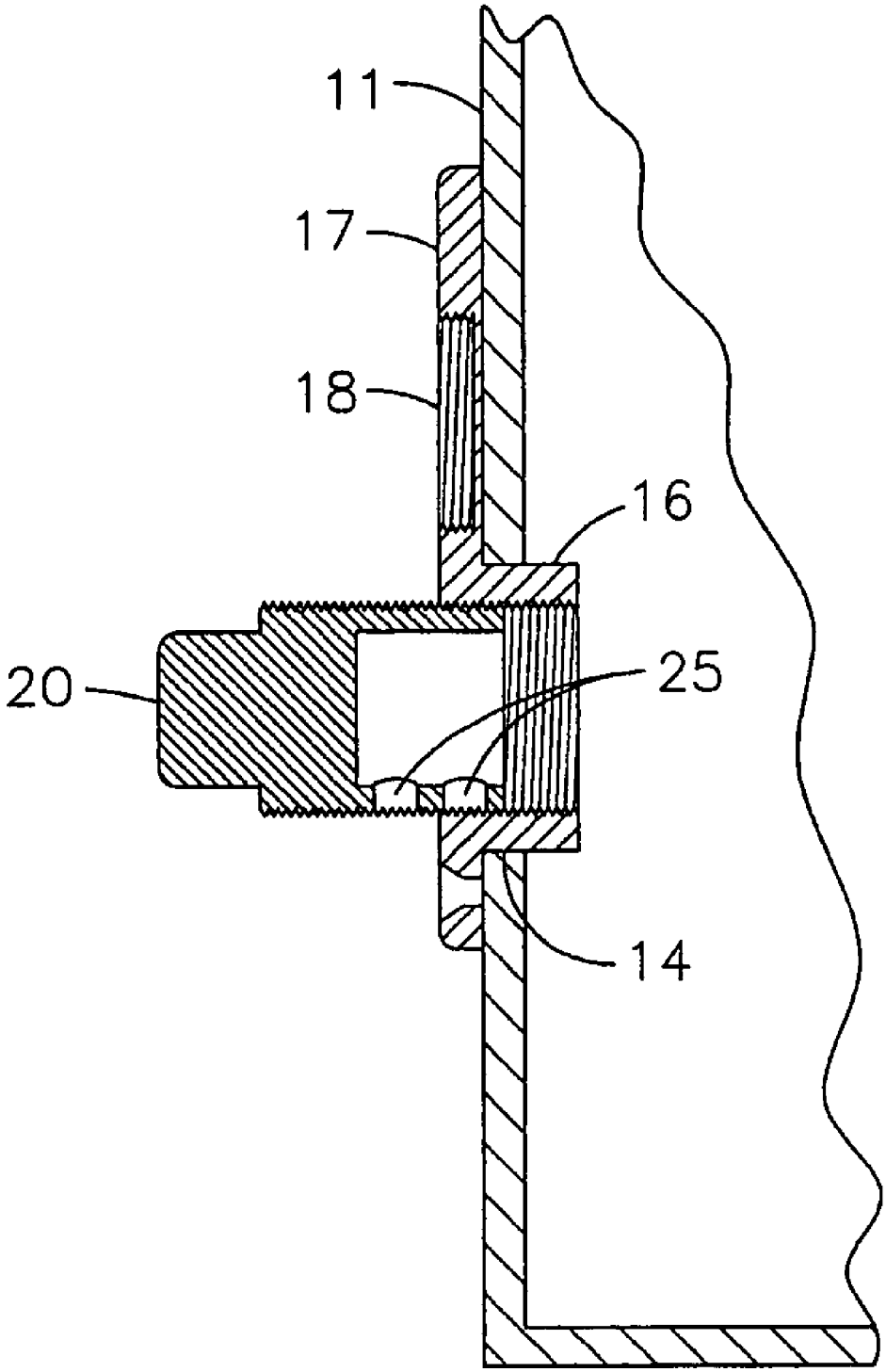
FIG. 6 is a side view of the present invention with water disbursement openings in the drain plug.

Though the illustrations and explanation provided above regarding the embodiment illustrated in FIGS. 4 & 5 disclose the opening 25 being in the sleeve 16. Those skilled in the art will recognize that the present invention can also be accomplished by placing the opening 25, discussed above, in a hollow plug 20. Thus, as illustrated in FIG. 6, a sleeve 16 does not need to extend from the hull 11 to allow an area for openings 25. Instead when the plug 20 has been removed a sufficient distance from the sleeve 16, water can flow from or through a hole 25 or opening(s) in the plug 20, preferably, but not limited to, once the holes 25 are facing in a downward direction. Again, if more of an opening is needed, the plug 20 can be completely removed and then connected to the second opening 18 of the present invention 10.

While the invention has been described in what is presently considered to be a preferred embodiment, many variations or modifications will become apparent to those skilled in the art. Accordingly, it is intended that the invention not be limited to the specific illustrated embodiment but be interpreted within the full spirit and scope of the appended claims.

The invention claimed is:

1. A boat drain plug system for attachment to a drain hole within a boat hull, the system comprising a) a flange including a threaded sleeve that fits within the drain hole and a second threaded opening;

b) a cylindrical drain plug adapted for individually coupling with the threaded sleeve and the second threaded opening; and c) wherein the drain plug may be fitted into the second threaded opening to secure the drain plug when the sleeve needs to be completely open to allow water to exit a boat.

2. The boat drain plug system of claim 1 wherein the sleeve extends away from the boat hull and further comprises a drain opening therethrough a wall of the sleeve, away from the boat hull, which is sealed and unsealed based on how engaged the drain plug is with the sleeve.

3. The boat drain plug system of claim 2 wherein when debris blocks a flow of water from the drain opening, said drain plug is removed from the sleeve and secured to the threaded opening.

4. The boat drain plug system of claim 1 wherein the drain plug comprises an opening in a sidewall of the drain plug and that has access to the sleeve which is sealed and unsealed based on how engaged the drain plug is with the sleeve.

5. The boat drain plug system of claim 4 wherein when debris blocks a flow of water from the opening in the drain plug, the drain plug is removed from the sleeve and secured to the threaded opening.

6. The boat drain plug system of claim 1 further comprising connectors to secure the system to the boat hull.

7. An improvement to a boat drain plug apparatus wherein a boat hull has a drain opening formed in the boat hull through which a threaded sleeve fits and a drain plug, that is threaded, fits within the sleeve, the improvement comprising a threaded plug holder opening attached to the boat hull operable to receive the drain plug when the drain plug is removed from the sleeve and wherein the drain plug further comprises an opening in a side of the drain plug and that has access to a flow of water from the sleeve and which is sealed and unsealed based on how engaged the drain plug is with the sleeve.

8. The improvement of claim 7 wherein the sleeve extends away from the boat hull and further comprises a drain opening therethrough a wall of the sleeve, away from the boat hull, which is sealed and unsealed based on how engaged the drain plug is with the sleeve.

9. The improvement of claim 8 wherein when debris blocks a flow of water from the drain opening, the drain plug is removed from the sleeve and secured to the threaded plug holder opening.

10. The improvement of claim 7 wherein when debris blocks a flow of water from the opening in the drain plug, the drain plug is removed from the sleeve and secured to the threaded plug holder opening.

11. A boat drain plug apparatus wherein a boat hull has a drain opening formed in a boat hull, the apparatus comprising:

a) a threaded sleeve that fits within a drain opening;

b) a cylindrical drain plug adapted for coupling with the threaded sleeve;

c) a threaded plug holder opening attached to the boat hull operable to receive the drain plug when the drain plug is removed from the sleeve; and wherein the drain plug further comprises an opening in a sidewall of the drain plug that has access to the sleeve which is sealed and unsealed based on how engaged the drain plug is with the sleeve.

12. The boat drain plug apparatus of claim 11 wherein the sleeve extends away from the boat hull and further comprises a drain opening therethrough a wall of the sleeve away from the boat hull which is sealed and unsealed based on how engaged the drain plug is with the sleeve.

13. The boat drain plug apparatus of claim 12 wherein when debris blocks a flow of water from the drain opening, said drain plug is removed from the sleeve and secured to the threaded opening.

14. The boat drain plug apparatus of claim 11 wherein when debris blocks a flow of water from the opening in the drain plug, the drain plug is removed from the sleeve and secured to the threaded opening.

15. The boat drain plug apparatus of claim 11 wherein the threaded sleeve and threaded plug holder opening are integrated and are formed from a single component.

16. The boat drain plug apparatus of claim 15 wherein the single component is at least one of a piece of brass or plastic.

17. The boat drain plug apparatus of claim 15 wherein the single component comprises a flange that comprises a surface area that is disposed against an exterior surface of the boat hull.

18. The boat drain plug apparatus of claim 11 wherein the threaded plug holder opening comprises at least one of an opening that results in a boat hull being visible or an opening that is closed wherein the boat hull is not visible through the opening.

* * * * *